US011965224B2

(12) United States Patent
Nonaka et al.

(10) Patent No.: US 11,965,224 B2
(45) Date of Patent: Apr. 23, 2024

(54) STEEL SHEET FOR CAN AND MANUFACTURING METHOD THEREOF

(71) Applicant: NIPPON STEEL CORPORATION, Tokyo (JP)

(72) Inventors: Toshiki Nonaka, Tokyo (JP); Toru Yonebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/788,131

(22) PCT Filed: Feb. 17, 2020

(86) PCT No.: PCT/JP2020/006010
§ 371 (c)(1),
(2) Date: Jun. 22, 2022

(87) PCT Pub. No.: WO2021/166026
PCT Pub. Date: Aug. 26, 2021

(65) Prior Publication Data

US 2023/0039571 A1 Feb. 9, 2023

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C22C 38/04
See application file for complete search history.

(56) References Cited

U.S. PATENT DOCUMENTS

2011/0168303 A1* 7/2011 Kato ..... C21D 9/46 420/128
2017/0081739 A1* 3/2017 Kern ..... C21D 8/0263
2017/0292176 A1* 10/2017 Tsujimoto ..... C22C 38/00

FOREIGN PATENT DOCUMENTS

EP 1 741 800 A1 1/2007
JP 2005-320633 A 11/2005
JP 2005-336610 A 12/2005

OTHER PUBLICATIONS

Bell, "Final report on effect of impurities in steel." 2006, Final Report of Natural Resources Canada, Natural Resources Canada, Canada, Bd. Report 2005-41, retrieved from: https://www.researchgate.net/publication/306293969, pp. 1-25. (Year: 2006).*

* cited by examiner

*Primary Examiner* — Monique R Jackson
(74) *Attorney, Agent, or Firm* — Birch, Stewart, Kolasch & Birch, LLP

(57) ABSTRACT

This steel sheet for a can is a steel sheet for a can containing, by mass %, C: 0.010% to 0.050%, Si: 0.020% or less, Mn: 0.10% to 0.60%, P: 0.020% or less, S: 0.020% or less, Al: 0.050% or less, N: 0.0100% or less, Nb: 0% to 0.03%, Ti: 0% to 0.03%, B: 0% to 0.0020%, and a remainder including Fe and unavoidable impurities, in which, when the number of carbides having an equivalent circle diameter of 2 μm or more and 5 μm or less is indicated by a, and the number of carbides having an equivalent circle diameter of 0.1 μm or more and less than 2 μm is indicated by b, a/b satisfies a range of the following formula (1), a fracture strain is 1.6 or more, and a sheet thickness is 0.10 to 0.30 mm $$a/b<0.12 \quad \ldots (1).$$

10 Claims, 3 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C21D 8/0226* (2013.01); *C21D 8/0236* (2013.01); *C21D 8/0268* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/004* (2013.01)

STEEL SHEET FOR CAN AND MANUFACTURING METHOD THEREOF

TECHNICAL FIELD OF THE INVENTION

The present invention relates to a steel sheet for a can and a manufacturing method thereof.

RELATED ART

Steel sheets for cans, particularly, steel sheets for film-laminated cans, aim at weight reduction and cost reduction by gauge reduction (thinning) in order to compete with aluminum cans. However, when the sheet thickness becomes thin, an increase in can body breakage after the production of two-piece cans is conceivable, and improvement in the quality of materials becomes essential. Incidentally, improvement in elongation or the r value (Lankford value) alone appears to be unsatisfactory in improving formability during can production, and, actually, as a result of comparison by can makers between steel sheet coils that frequently allow can body breakage and steel sheet coils that result in a small number of can body breakage cases, there has been no difference in all of YP (yield stress), TS (tensile strength), El (elongation), and the r value.

Therefore, there has been a need to find a new requirement for manufacturing a steel sheet coil that does not allow can body breakage during the production of two-piece cans in spite of gauge reduction and to invent a method for indexing and improving the requirement. For example, Patent Document 1 discloses a technique for obtaining a high strength-ductility balance by a composite combination of precipitation hardening by a Nb carbide or solid solution strengthening by P. In addition, Patent Document 2 discloses a technique for obtaining a high r value and favorable anisotropy by using ultra-low carbon steel having a C content of 0.0020% or less.

PRIOR ART DOCUMENT

Patent Document

[Patent Document 1] Japanese Unexamined Patent Application, First Publication No. 2005-336610

[Patent Document 2] Japanese Unexamined Patent Application, First Publication No. 2005-320633

DISCLOSURE OF THE INVENTION

Problems to be Solved by the Invention

However, all of the above-described related arts have problems. The invention described in Patent Document 1 obtains a high strength-ductility balance by a composite combination of precipitation hardening by a Nb carbide or solid solution strengthening by P. However, steels for which precipitation hardening is used, such as NbC, are poor in anisotropy. In addition, in spite of the favorable strength-ductility balance, favorable formability cannot be obtained in DRD cans (polyester-laminated deep drawing cans) or DI cans (drawing ironing cans).

In addition, in the invention described in Patent Document 2, a high r value and favorable anisotropy are obtained by using ultra-low carbon steel having a C content of 0.0020% or less. However, in the case of manufacturing ultra-low carbon steel, it is necessary to inject oxygen into molten steel to remove C in the steel. Therefore, an inclusion of alumina or the like is generated. Furthermore, it is known that, when the gauge of ultra-low carbon steel is thinned, can body breakage occurs in the can wall due to an inclusion at a stage of can formation, and ultra-low carbon steel is not suitable for two-piece cans having a thin gauge.

Therefore, the present inventor carried out intensive studies to solve the above-described problems of the related art and to realize a steel sheet for a can having excellent formability and a manufacturing method thereof. As a result, the following findings were obtained.

In order to reduce the can body breakage rate after the production of two-piece cans, a new requirement, which is not elongation or the r value, and the indexing of the new requirement become necessary. Can production is not simple tensile forming, and ironing forming is added. Therefore, elongation in tensile tests is not sufficient as an index that indicates formability. When the sheet thickness decreases during forming, necking occurs in a certain portion, and the sheet becomes unbearable, can body breakage occurs. That is, there is a need for an index that indicates how much a steel sheet can bear as the distortion of the steel sheet progresses due to forming.

Here, the present inventors studied whether or not it is possible to easily evaluate how much a steel sheet can bear forming using a tensile test that is ordinarily carried out and paid attention to the sheet thicknesses and the sheet widths before distortion and immediately before (immediately after) fracture in the tensile test. As the Δ sheet thickness and the Δ sheet width increase, the formability becomes more favorable, and these were regarded as a new evaluation index of "fracture strain". When the fracture strain is indicated by ε, ε is expressed as $\ln(t/t0)+\ln(w/w0)$. Here, t0 and w0 are the sheet thickness and the sheet width before distortion, and t and w are the sheet thickness and the sheet width immediately before (immediately after) fracture. In addition, as a tensile test piece, a dumbbell-type test piece specified in JIS No. 6 was used. Regarding specific test conditions, the tensile test was carried out according to examples to be described below.

The present inventors asked consumers to carry out various types of can forming and collected data on the can body breakage rates at those times. Here, the can body breakage rate is the number proportion of cans that are broken in the can body during can forming. In addition, the present inventors separately measured the fracture strain of steel sheets for a can provided to the consumers and investigated the correlation between the can body breakage rate and the fracture strain. As a result, as shown in FIG. 1, it was clarified that, when the fracture strain $\varepsilon \geq 1.6$, the can body breakage rate was less than 50 ppm. When the can body breakage rate is less than about 50 ppm, it is assumed that no claims are raised by consumers. Therefore, the goal is to manufacture a steel sheet having a fracture strain of 1.6 or more.

As a result of intensive studies, the inventors found that, when the forms of a carbide (cementite), that is, the number, size, and distribution thereof, are controlled, it is possible to improve the fracture strain and the condition of the fracture strain being 1.6 or more is satisfied. In addition, it was found that, as will be described below, the forms of a carbide are affected by the amount of C, the coiling temperature (CT), the annealing temperature, the rolling reduction in temper rolling, and furthermore, an overaging treatment.

It was found that, when the value of this fracture strain is equal to or more than a specific value, it is possible to suppress the can body breakage rate to an extent that it is assumed that no claims are raised by consumers. Furthermore, the present inventors found that, in order to obtain a favorable value of the fracture strain, it is preferable to control the forms of a carbide or the coiling temperature, the annealing temperature, the ratio between a first stand rolling reduction and a second stand rolling reduction in secondary cold rolling, the overaging temperature, and the overaging time, which are manufacturing conditions, to specific ranges.

The present invention has been made from such a background, and an object of the present invention is to solve the above-described problems of the related art and to realize a steel sheet for a can having excellent formability and a manufacturing method thereof.

Means for Solving the Problem

In order to solve the above-described problems, a steel sheet for a can is a steel sheet for a can containing, by mass %, C: 0.010% to 0.050%, Si: 0.020% or less, Mn: 0.10% to 0.60%, P: 0.020% or less, S: 0.020% or less, Al: 0.050% or less, N: 0.0100% or less, Nb: 0% to 0.03%, Ti: 0% to 0.03%, B: 0% to 0.0020%, and a remainder including Fe and an impurity, in which, among carbides observed in a cross section of the steel sheet for a can, when the number of carbides having an equivalent circle diameter of 2 μm or more and 5 μm or less is indicated by a, and the number of carbides having an equivalent circle diameter of 0.1 μm or more and less than 2 μm is indicated by b, a/b satisfies a range of the following formula (1), a fracture strain is 1.6 or more, and a sheet thickness is 0.10 to 0.30 mm.

$$a/b<0.12 \quad (1)$$

In addition, the steel sheet for a can preferably contains, by mass %, at least one selected from the group consisting of Nb: 0.003% to 0.03%, Ti: 0.003% to 0.03%, and B: 0.0005% to 0.0020%.

In addition, it is preferable that a Sn plating, a Cr plating, or a plating of an alloy thereof is provided on a surface of the steel sheet for a can, and it is preferable that an organic membrane or a resin membrane is provided on a surface of the plating.

In addition, a manufacturing method of a steel sheet for a can is a manufacturing method of a steel sheet for a can that is formed by hot-rolling a steel piece containing, by mass %, C: 0.010% to 0.050%, Si: 0.020% or less, Mn: 0.10% to 0.60%, P: 0.020% or less, S: 0.020% or less, Al: 0.050% or less, N: 0.0100% or less, Nb: 0% to 0.03%, Ti: 0% to 0.03%, B: 0% to 0.0020%, and a remainder including Fe and an impurity, then, coiling a hot-rolled sheet obtained by the hot rolling at a coiling temperature of 640° C. or lower, pickling and cold-rolling the hot-rolled sheet to obtain a cold-rolled sheet, then, annealing the cold-rolled sheet at 680° C. or higher, carrying out an overaging treatment on the annealed cold-rolled sheet, and then carrying out secondary cold rolling, in which the following formula (2) is satisfied.

$$300<3T_1^{0.7}-(r1/r2)^{1.5}+\{(T_2-720)^2\}/4+(T_3 \log t)/3<1000 \quad (2)$$

(In the formula (2), $T_1$ is the coiling temperature (° C.) of the hot-rolled sheet, r1 is a first stand rolling reduction (%) of the secondary cold rolling, r2 is a second stand rolling reduction (%) of the secondary cold rolling, $T_2$ is an annealing temperature (° C.), $T_3$ is an overaging temperature (° C.), and t is an overaging time (seconds))

In addition, the steel sheet for a can preferably contains, by mass %, at least one selected from the group consisting of Nb: 0.003% to 0.03%, Ti: 0.003% to 0.03%, and B: 0.0005% to 0.0020%.

In addition, it is preferable that a Sn plating, a Cr plating, or a plating of an alloy thereof is provided on a surface of the steel sheet for a can.

In addition, it is preferable that an organic membrane or a resin membrane is provided on a surface of the plating.

Effects of the Invention

The use of the present invention makes it possible to realize a steel sheet for a can having excellent formability and a manufacturing method thereof.

EMBODIMENTS OF THE INVENTION

Figure 1:
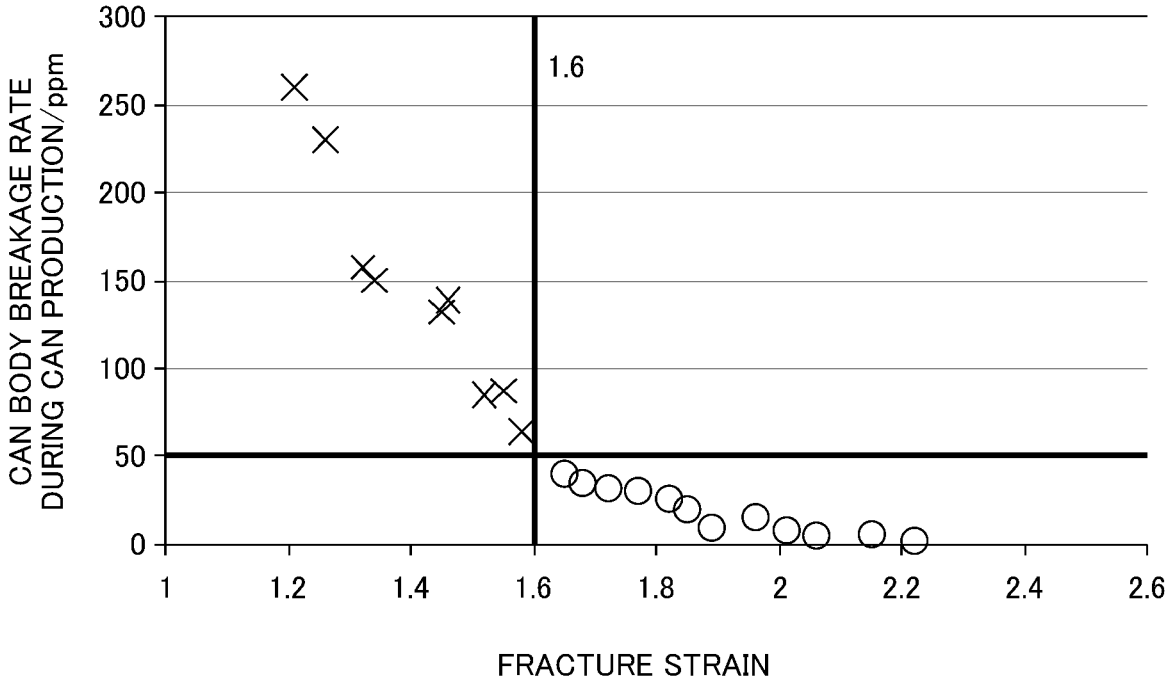
FIG. 1 is a view showing the relationship between fracture strain and the can body breakage rate (ppm) during can production.

Hereinafter, the present invention will be described in detail by taking an embodiment as an example. The present invention is not limited to the following embodiment. A steel sheet for a can of the present invention is a steel sheet for a can having a composition containing, by mass %, C: 0.010% to 0.050%, Si: 0.020% or less, Mn: 0.10% to 0.60%, P: 0.020% or less, S: 0.020% or less, Al: 0.050% or less, N: 0.0100% or less, Nb: 0% to 0.03%, Ti: 0% to 0.03%, B: 0% to 0.0020%, and a remainder including Fe and an impurity, in which a ratio between the number of carbides having a small equivalent circle diameter and the number of carbides having a large equivalent circle diameter satisfies a specific range, a fracture strain is favorable, and a sheet thickness is 0.10 to 0.30 mm. In addition, a manufacturing method suitable for manufacturing a steel sheet for a can is a manufacturing method of a steel sheet for a can that is formed by coiling a hot-rolled sheet at a coiling temperature of 640° C. or lower, pickling and cold-rolling the hot-rolled sheet to obtain a cold-rolled sheet, then, annealing the cold-rolled sheet at 680° C. or higher, carrying out an overaging treatment on the annealed cold-rolled sheet, and then carrying out secondary cold rolling. According to the present invention, a steel sheet for a can having excellent formability can be obtained. Furthermore, a steel sheet for a can that allow can body breakage less frequently during can forming can be obtained. In addition, according to the present invention, additional thinning of a steel sheet that is used for food cans, beverage cans, and the like becomes possible, it is possible to achieve resource saving and cost reduction, and an extreme industrial effect is exhibited.

Hereinafter, the composition, steel sheet structure, and manufacturing method of the steel sheet for a can of the present invention will be described in order. First, the composition of the steel sheet for a can of the present invention will be described. In the description of the composition, the content of each component is mass % (more strictly, mass % with respect to the total mass of a sample used for the measurement of mass %).

C: 0.010% to 0.050%

When the amount of C, as a steel component, exceeds 0.050%, the number of carbides increases as described below, and, in particular, the number of carbides having a large equivalent circle diameter increases, which adversely affects the fracture strain. Furthermore, the amount of C is set to 0.050% or less in order to significantly reduce both the r value and the ductility. On the other hand, when the amount of C is less than 0.010%, it becomes difficult to secure a necessary strength, and thus the amount of C is set to 0.010% or more.

Si: 0.020% or less

Since the upper limit of the amount of Si is 0.020% in terms of the ASTM standard, the upper limit of the amount of Si in steel of the present invention is also set to 0.020%. In addition, the lower limit of the amount of Si is not particularly specified and may be 0%; however, Si is contained as an impurity in iron ore or manganese ore, and the complete removal of Si takes a cost, and thus the lower limit is desirably 0.005%.

Mn: 0.10% to 0.60%

Mn is an element effective for preventing hot cracking due to S, and the amount of Mn needs to be 0.10% or more. Furthermore, when the amount of Mn is less than 0.10%, the strength becomes insufficient. In addition, the upper limit of the amount of Mn is 0.60% in terms of the ASTM standard, and thus the upper limit of the amount of Mn in the steel of the present invention is also set to 0.60%.

P: 0.020% or less

P is a harmful element that hardens the steel and degrades the workability and causes can body breakage during forming, and thus the upper limit of the amount of P is set to 0.020%. The lower limit of the amount of P is not particularly specified and may be 0%; however, the cost and time for dephosphorization become necessary, and thus the lower limit is desirably set to 0.001%.

S: 0.020% or less

Since S is an element that is present as an inclusion in the steel, reduces ductility, causes surface cracking, and causes poor external appearance and the deterioration of the corrosion resistance, the upper limit of the amount of S is set to 0.020%. The lower limit of the amount of S is not particularly specified and may be 0%, but the lower limit is desirably set to 0.001% for the convenience of the desulfurization cost and the desulfurization time.

Al: 0.050% or less

In a case where more than 0.050% of Al is added, since AlN is coarsened and adversely affects the formability, the upper limit is set to 0.050%. In addition, when the castability by deoxidation is taken into account, 0.005% or more of Al is preferably added.

N: 0.0100% or less,

N is a solid solution strengthening element and is an element necessary for securing the strength of the steel sheet; however, when the addition amount exceeds 0.0100%, the workability is significantly degraded. In addition, since N causes the occurrence of slab cracking during continuous casting, the upper limit is set to 0.0100%. The lower limit of the amount of N is not particularly specified and may be 0%; however, when the above-described effects are taken into account, 0.0020% or more of N is preferably added.

Nb: 0.003% to 0.03%, Ti: 0.003% to 0.03% or less, B: 0.0005% to 0.0020% or less

All of these are elements that form a carbide or a nitride and are effective for improving the workability and may be selectively contained as necessary. When more than 0.03% of Nb is contained, the recrystallization temperature rises due to the crystal grain boundary austenite pinning effect of a Nb-based precipitate, and the sheet threading workability of continuous annealing furnaces deteriorates. In order to obtain a workability improvement effect, 0.003% or more of Nb is desirably contained. When more than 0.03% of Ti is contained, a full hard precipitate is formed and the corrosion resistance deteriorates. In order to obtain a workability improvement effect, 0.003% or more of Ti is desirably contained. When more than 0.0020% of B is contained, B is segregated in the recrystallized grain boundaries during continuous annealing and recrystallization is delayed. In order to obtain a workability improvement effect, 0.0005% or more of B is desirably contained.

The remainder of the steel includes Fe and an impurity. The impurity refers to an element that is contained by accident from ore or scrap that is a raw material or from manufacturing environments or the like at the time of industrially manufacturing the steel. The impurity is, for example, an unavoidable impurity. Examples of the unavoidable impurity include Sn, As, and the like. The above-described chemical composition of the steel sheet may be measured by an ordinary analytical method. For example, the steel component may be measured using inductively coupled plasma-atomic emission spectrometry (ICP-AES). C and S may be measured using an infrared absorption method after combustion, and N may be measured using an inert gas melting-thermal conductivity method.

Figure 2:
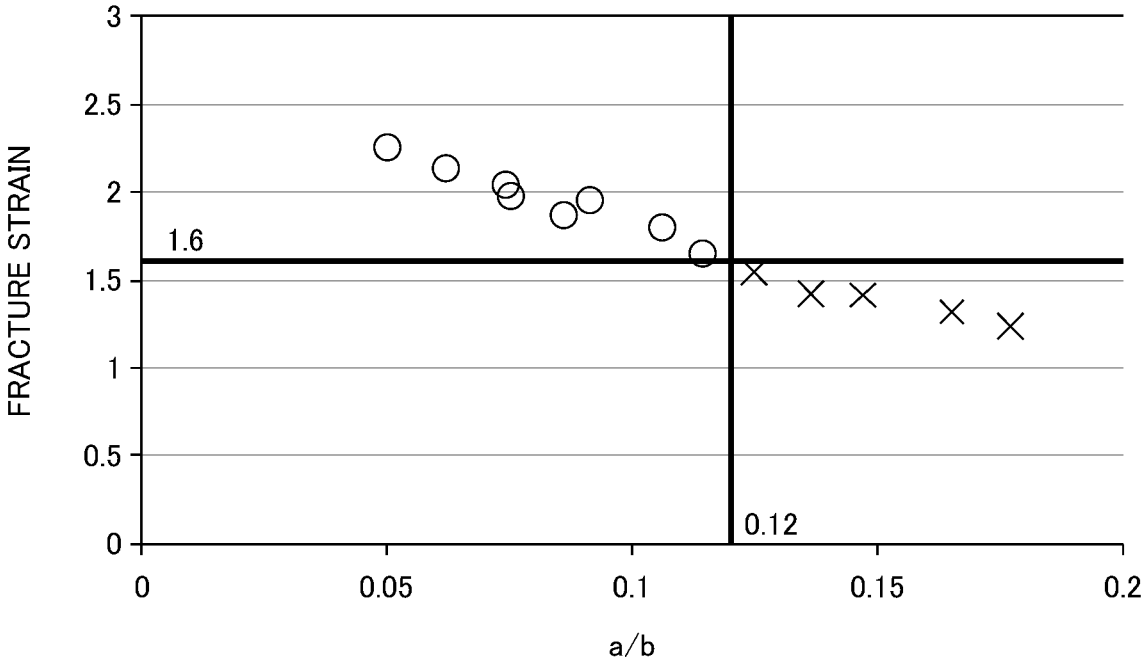
FIG. 2 is a view showing the relationship between a/b where a indicates the number of carbides having an equivalent circle diameter of 2 μm or more and 5 μm or less and b indicates the number of carbides having an equivalent circle diameter of 0.1 μm or more and less than 2 μm and fracture strain.

Next, the steel sheet structure of the present invention will be described. When the number of carbides in which the equivalent circle diameters of the carbides are 2.0 μm or more and 5.0 μm or less is indicated by a, and the number of carbides having an equivalent circle diameter of 0.1 μm or more and 2.0 μm or less is indicated by b, if the following formula (1) is not satisfied as shown in FIG. 2, the fracture strain of 1.6 or more is not satisfied. Here, FIG. 2 is a graph obtained by observing the cross sections of a plurality of types of steel sheets having different fracture strain by a method to be described below and measuring a/b.

$$a/b<0.12 \quad (1)$$

The values of a/b represents the distribution state of the carbides, and, according to FIG. 2, it is shown that, even when the numbers of the carbides are the same, the fracture strain is favorable in a state where the number of the carbides having a small equivalent circle diameter is large and the number of the large carbides is small.

Figure 3:
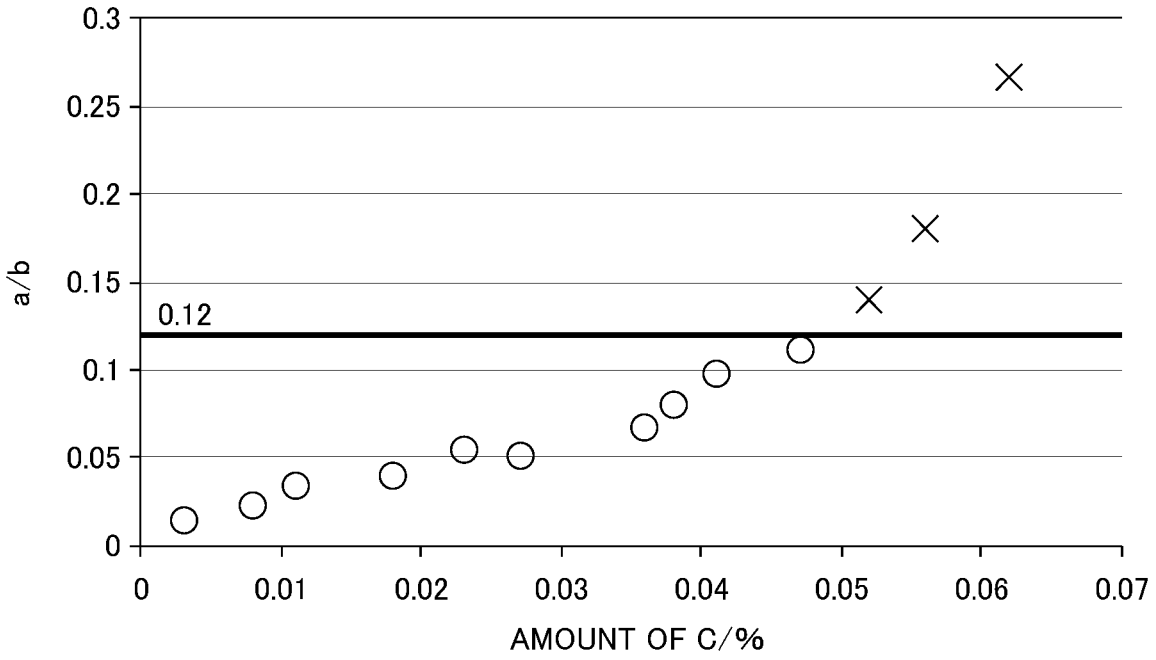
FIG. 3 is a view showing the relationship between the amount of carbon by mass % and a/b where a indicates the number of carbides having an equivalent circle diameter of 2 μm or more and 5 μm or less and b indicates the number of carbides having an equivalent circle diameter of 0.1 μm or more and less than 2 μm.

Appropriate equivalent circle diameters of the carbides can be obtained by controlling the amount of C among the components in the steel. As shown in FIG. 3, basically, when the amount of C is 0.050% or less, the equivalent circle diameters become small and it becomes easy to satisfy the formula (1). However, when the amount of C becomes too small and becomes less than 0.010%, a necessary strength of the steel sheet cannot be obtained. Therefore, there is an appropriate amount for the amount of C, and the range is preferably 0.010% to 0.050%. Here, FIG. 3 is a graph obtained by producing hot-rolled sheets by carrying out hot rolling on steel pieces having different amounts of C under the same conditions as in examples to be described below, observing the cross sections of the hot-rolled sheets by the method to be described below, and measuring (a/b)'s. Therefore, when the amount of C is set to 0.010% to 0.050%, and then a formula (2), which is a formula of the coiling temperature after hot rolling to be described below or the other operating conditions, is satisfied, it becomes possible to satisfy the formula (1).

The number of the carbides can be specified by, for example, observing the cross section of the steel sheet with an optical microscope at a magnification of 1000 times. More specifically, in the cross section perpendicular to a rolling direction of the steel sheet, photographs of 10 visual fields having a size of 140 μm×100 μm at the central part in the sheet thickness direction and the central part in the sheet width direction are captured into a personal computer. Next, it is preferable that the number of carbides in each visual field is counted by the size using analysis software provided in a microscope VHX500 manufactured by KEYENCE corporation and the average of the 10 visual fields is obtained. When the equivalent circle diameter of a carbide is smaller than 0.1 since measurement is not possible, carbides having an equivalent circle diameter of less than 0.1 μm are not counted.

Figure 4:
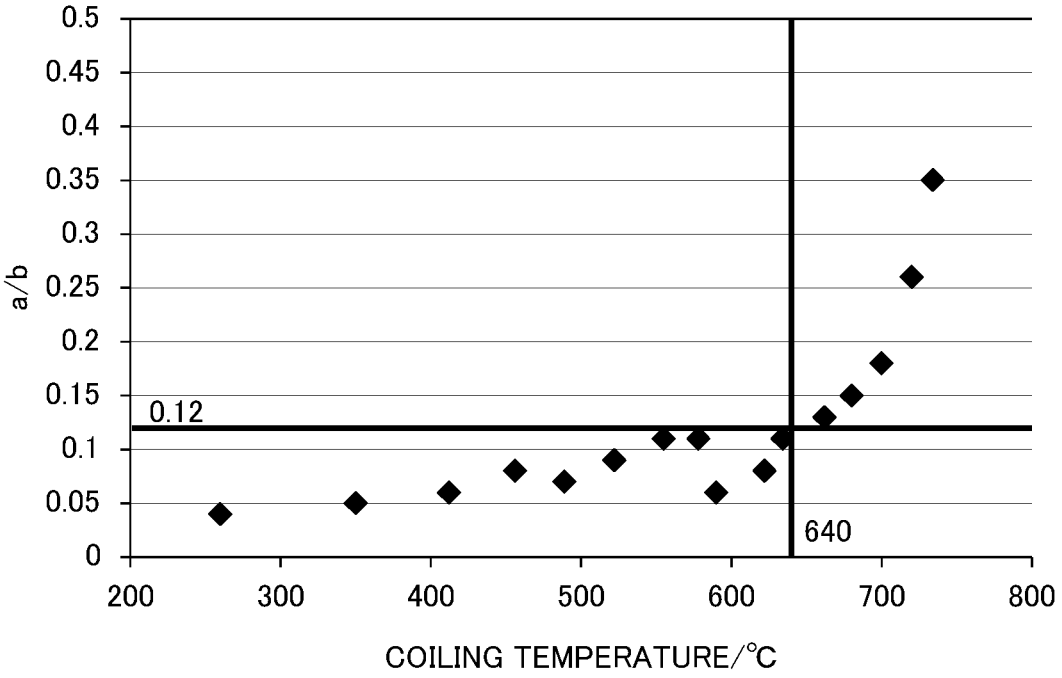
FIG. 4 is a view showing the relationship between a coiling temperature and a/b where a indicates the number of carbides having an equivalent circle diameter of 2 μm or more and 5 μm or less and b indicates the number of carbides having an equivalent circle diameter of 0.1 μm or more and less than 2 μm.

Furthermore, the coiling temperature after the hot rolling of the steel sheet also affects the numbers of the carbides. As shown in FIG. 4, when the coiling temperature is low, the number of coarse carbides in the hot-rolled sheet decreases. That is, the value of a/b in the formula (1) becomes small. When the number of coarse carbides during hot rolling is small, it can be expected that the number of carbide in a completed product sheet is also small. Here, FIG. 4 is a graph obtained by observing the cross sections of hot-rolled sheets for which the components in steel are common but the coiling temperatures are different (hot rolling is carried out in the same manner as in the examples to be described below) by the above-described method and measuring (a/b)'s. The coiling temperature is desirably 640° C. or lower. However, when the coiling temperature is 200° C. or lower, the strength of the hot-rolled sheet is too high, and the cold rolling load is too large, which is supposed to be avoided. However, in this case, an assumption is that the formula (2) to be described below is satisfied. The sheet thickness of the steel sheet for a can is preferably 0.10 to 0.30 mm.

Figure 5:
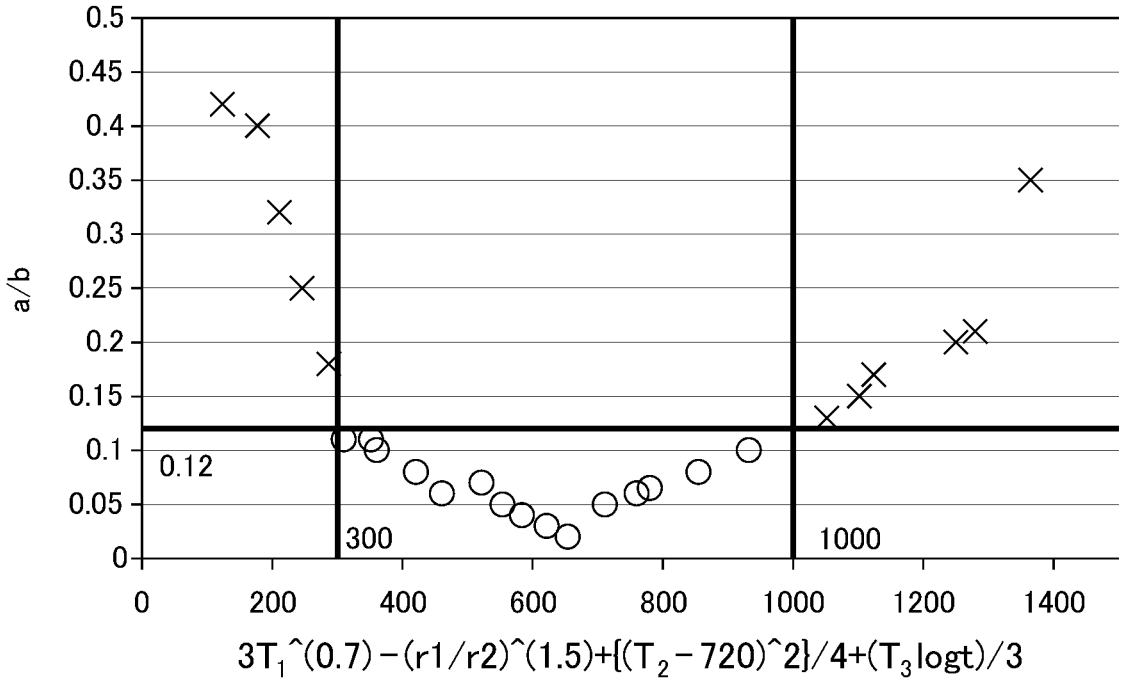
FIG. 5 is a view showing the relationship between a value of $3T_1^{0.7}-(r1/r2)^{1.5}+\{(T_2-720)^2\}/4+(T_3 \log t)/3$ and a/b where a indicates the number of carbides having an equivalent circle diameter of 2 μm or more and 5 μm or less and b indicates the number of carbides having an equivalent circle diameter of 0.1 μm or more and less than 2 μm. Here, $T_1$ is the coiling temperature (° C.) of the hot-rolled sheet, r1 is a first stand rolling reduction (%) of the secondary cold rolling, r2 is a second stand rolling reduction (%) of the secondary cold rolling, $T_2$ is an annealing temperature, $T_3$ is an overaging temperature (° C.), and t is an overaging time (seconds).

In addition, in the manufacturing method, the final numbers of the carbides are controlled by satisfying the above-described amount of C and the upper limit of the coiling temperature after hot rolling and then placing the coiling temperature in hot rolling, the heating temperature at the time of annealing, the conditions for subsequent temper rolling, and furthermore, an overaging treatment under a predetermined balance. The inventors investigated the influences of the individual factors and consequently clarified that, in a case where the following formula (2) is satisfied, as shown in FIG. 5, the numbers of the carbides satisfy the predetermined ranges, and a/b<0.12 in the formula (1) is satisfied, whereby the fracture strain becomes 1.6 or more. Here, FIG. 5 is a graph obtained by observing the cross sections of cold-rolled sheets for which the components in steel are common but the values of $3T_1^{0.7}-(r1/r2)^{1.5}+\{(T_2-720)^2\}/4+(T_3 \log t)/3$ are different (other conditions are the same as in the examples to be described below) by the above-described method and measuring (a/b)'s. $T_1$ is the coiling temperature (° C.), $T_2$ is the annealing temperature (° C.), r1 is a first stand rolling reduction (%) of the secondary cold rolling, r2 is a second stand rolling reduction (%) of the secondary cold rolling, $T_2$ is an annealing temperature, $T_3$ is an overaging temperature (° C.), and t is an overaging time (seconds). Here, $T_3$ is the average value of the overaging start temperature and the overaging end temperature.

$$300<3T_1^{0.7}-(r1/r2)^{1.5}+\{(T_2-720)^2\}/4+(T_3 \log t)/3<1000 \quad (2)$$

"3T1^(0.7)−(r1/r2)^(1.5)+{(T2−720)^2}/4+(T3 log t)/3" in FIG. 5 means "$3T_1^{0.7}-(r1/r2)^{1.5}+\{(T_2-720)^2\}/4+(T_3 \log t)/3$".

When the annealing temperature is high, since it is possible to decrease the number of carbides present before annealing, the annealing temperature is desirably 680° C. or higher. However, when the annealing temperature is too high, since the possibility of in-furnace fracture increases, the annealing temperature is preferably 850° C. or lower.

Furthermore, when the overaging temperature in the overaging treatment is lowered, it is possible to decrease the number of carbides. When the average value (arithmetic average value) of the overaging start temperature and the overaging end temperature is indicated by $T_3$, $T_3$ is preferably 400° C. or lower. On the other hand, when the average value is lower than 250° C., since the cooling rate becomes fast, the sprayed water density increases, and the steel sheet becomes unstable. Therefore, the average value is preferably 250° C. or higher.

In addition, when the overaging time in the overaging treatment is shortened, it is possible to decrease the number of carbides. The overaging time is preferably shorter than 400 seconds. However, when the time is excessively short, it means that the sheet threading speed becomes too fast, and, in this case, there is a risk of fracture. Therefore, the overaging time is preferably 50 seconds or longer.

In addition, for the secondary cold rolling, the rolling reduction is desirably 20% or less for both the first stand and the second stand. When the rolling reduction exceeds 20%, the strength becomes too high, and the elongation also significantly decreases, which makes forming difficult. In addition, the rolling reduction is desirably 1% or more in order for shape correction.

By the above-described steps, the steel sheet for a can of the present invention can be obtained. In the present invention, it is possible to further carry out various steps after the secondary cold rolling. For example, a Sn plating, a Cr plating, or a plating of an alloy thereof may be provided on the surface of the steel sheet for a can of the present invention as necessary, and an organic membrane or a resin membrane may be further provided on the surface of the plating as necessary.

EXAMPLES

Molten steels having a composition shown in Table 1 were manufactured in a vacuum melting furnace, the molten steels were cooled and solidified, then, steel pieces were reheated up to 1200° C., and the steel pieces were finish-rolled at 880° C. After hot-rolled sheets were cooled, the hot-rolled sheets were held at a temperature shown in Table 2 for 1 hour to reproduce coiling heat treatments of the hot-rolled sheets. Scale was removed from the obtained hot-rolled sheets by grinding, and cold rolling was carried out at a rolling reduction of 90% or more. After that, on the cold-rolled sheets, the annealing of the cold-rolled sheets was carried out at a temperature shown in Table 2 using a continuous annealing simulator, the cold-rolled sheets were cooled, then, held at an overaging temperature for an overaging time in Table 2, then, further cooled to room temperature, and then secondary cold rolling was carried out at a first stand rolling reduction and a second stand rolling reduction shown in Table 2, thereby obtaining steel sheets having a sheet thickness of 0.12 to 0.25 mm.

TABLE 1

| Experiment symbol | | C | Si | Mn | P | S | N | Al | Nb | Ti | B |
|---|---|---|---|---|---|---|---|---|---|---|---|
| A | Example | 0.014 | 0.015 | 0.21 | 0.015 | 0.013 | 0.0016 | 0.009 | | | |
| B | Example | 0.012 | 0.017 | 0.30 | 0.011 | 0.010 | 0.0085 | 0.035 | | | |
| C | Example | 0.016 | 0.011 | 0.13 | 0.004 | 0.012 | 0.0071 | 0.045 | | | |
| F | Example | 0.022 | 0.012 | 0.29 | 0.005 | 0.012 | 0.0055 | 0.007 | | | |
| G | Example | 0.035 | 0.012 | 0.20 | 0.012 | 0.004 | 0.0020 | 0.023 | | | |
| H | Example | 0.041 | 0.014 | 0.15 | 0.009 | 0.002 | 0.0030 | 0.040 | | | |
| I | Example | 0.046 | 0.012 | 0.13 | 0.013 | 0.015 | 0.0072 | 0.018 | | | |
| J | Example | 0.031 | 0.017 | 0.51 | 0.018 | 0.004 | 0.0089 | 0.030 | | | |
| K | Example | 0.038 | 0.011 | 0.45 | 0.012 | 0.004 | 0.0023 | 0.023 | | | |
| L | Example | 0.048 | 0.015 | 0.43 | 0.003 | 0.003 | 0.0017 | 0.006 | | | |
| M | Example | 0.048 | 0.009 | 0.14 | 0.019 | 0.006 | 0.0093 | 0.005 | | | |
| N | Example | 0.049 | 0.015 | 0.19 | 0.003 | 0.008 | 0.0034 | 0.009 | | | |
| O | Example | 0.036 | 0.014 | 0.39 | 0.011 | 0.016 | 0.0045 | 0.025 | 0.016 | | |
| P | Example | 0.040 | 0.014 | 0.45 | 0.004 | 0.012 | 0.0062 | 0.005 | | 0.025 | |
| Q | Example | 0.044 | 0.017 | 0.18 | 0.012 | 0.002 | 0.0019 | 0.023 | | | 0.001 |
| R | Example | 0.042 | 0.011 | 0.23 | 0.003 | 0.008 | 0.0027 | 0.009 | 0.025 | | 0.002 |
| S | Comparative Example | 0.008 | 0.014 | 0.16 | 0.019 | 0.005 | 0.0046 | 0.030 | | | |
| T | Comparative Example | 0.065 | 0.018 | 0.25 | 0.018 | 0.008 | 0.0024 | 0.045 | | | |
| U | Comparative Example | 0.046 | 0.007 | 0.75 | 0.007 | 0.015 | 0.0026 | 0.045 | | | |
| V | Comparative Example | 0.040 | 0.009 | 0.09 | 0.019 | 0.016 | 0.0044 | 0.026 | | | |
| W | Comparative Example | 0.033 | 0.015 | 0.21 | 0.045 | 0.018 | 0.0051 | 0.041 | | | |
| X | Comparative Example | 0.042 | 0.017 | 0.29 | 0.017 | 0.045 | 0.0033 | 0.024 | | | |
| Y | Comparative Example | 0.039 | 0.011 | 0.24 | 0.014 | 0.009 | 0.0107 | 0.033 | | | |
| Z | Comparative Example | 0.045 | 0.021 | 0.27 | 0.016 | 0.013 | 0.0037 | 0.104 | | | |
| AA | Comparative Example | 0.048 | 0.018 | 0.25 | 0.015 | 0.003 | 0.0032 | 0.032 | | | |
| AB | Comparative Example | 0.044 | 0.014 | 0.26 | 0.012 | 0.012 | 0.0026 | 0.048 | | | |
| AC | Comparative Example | 0.046 | 0.012 | 0.32 | 0.012 | 0.015 | 0.0031 | 0.031 | | | |
| AD | Comparative Example | 0.036 | 0.014 | 0.36 | 0.011 | 0.016 | 0.0045 | 0.025 | | | |
| AE | Comparative Example | 0.040 | 0.014 | 0.41 | 0.004 | 0.012 | 0.0062 | 0.005 | | | |

(unit: mass %)

JIS No. 6 tensile test pieces were taken from the steel sheets in a rolling direction, and the fracture strain was measured. After the working of the test pieces, the sheet thicknesses and sheet widths were measured at three parallel portions of the JIS No. 6 pieces, and the average values were calculated, These were defined as t0 and w0. In the sheet width measurement after a tensile test, fractured portions were butted to reproduce the shape immediately before the fracture, and the sheet width (w) of the most necked portion was measured. In the sheet thickness measurement after the tensile test, the fractured portions were butted to reproduce the shape immediately before the fracture, and the center portion in the width direction was cut along a tensile direction. In addition, the test piece was embedded in a resin such that the cut surface was exposed on the surface, polished, and observed with an optical microscope to measure the sheet thickness (t) of the thinnest portion. As a result of the above-described process, the sheet width w0 and the sheet thickness t0 before the tensile test and the sheet width w and the sheet thickness t after the tensile test were measured, and the value of the fracture strain was calculated.

Furthermore, a sample was cut out from the steel sheet and embedded in a resin such that a cross section perpendicular to the rolling direction of the steel sheet could be observed, and the cross section perpendicular to the rolling direction was polished and then corroded with Nital to reveal the metallographic structure. After that, the metallographic structure was enlarged 1000 times and observed with an optical microscope. A specific observation method is as described above. Next, the observed range was photographed and captured into a computer, the number of carbides and the equivalent circle diameters were measured using software, and a/b was measured.

Regarding can forming, 50,000 to 200,000 cans were produced using the steel sheet indicated by each experiment symbol. In a case where the can body breakage rate was less than 50 ppm, a/b was evaluated as O, and, in a case where the can body breakage rate was 50 ppm or more, a/b was evaluated as X. The experimental results are shown in Table 2.

From the above-described examples, when the requirements of the present invention are satisfied, it is possible to obtain an excellent steel sheet for a can in which can body breakage during can forming is small and the formability is high. On the other hand, in the comparative examples, since the component range deviates or there are many coarse

TABLE 2

| Experiment symbol | Steel piece | a | b | a/b Formula (1) | a/b determination | Coiling temperature T1 (° C.) | Annealing temperature T2 (° C.) | #1 Std cold rolling reduction (%) |
|---|---|---|---|---|---|---|---|---|
| 1 | A | 40 | 605 | 0.07 | ○ | 542 | 695 | 8 |
| 2 | B | 44 | 612 | 0.07 | ○ | 602 | 742 | 10 |
| 3 | C | 37 | 599 | 0.06 | ○ | 451 | 748 | 9 |
| 4 | F | 51 | 542 | 0.09 | ○ | 550 | 720 | 9 |
| 5 | G | 54 | 708 | 0.08 | ○ | 620 | 695 | 6 |
| 6 | H | 82 | 813 | 0.10 | ○ | 550 | 695 | 8 |
| 7 | I | 83 | 902 | 0.09 | ○ | 605 | 724 | 12 |
| 8 | J | 72 | 815 | 0.09 | ○ | 621 | 699 | 6 |
| 9 | K | 71 | 910 | 0.08 | ○ | 584 | 698 | 8 |
| 10 | L | 82 | 966 | 0.08 | ○ | 555 | 721 | 8 |
| 11 | M | 90 | 810 | 0.11 | ○ | 587 | 703 | 10 |
| 12 | N | 92 | 841 | 0.11 | ○ | 580 | 735 | 8 |
| 13 | O | 81 | 900 | 0.09 | ○ | 574 | 699 | 9 |
| 14 | P | 80 | 920 | 0.09 | ○ | 485 | 721 | 8 |
| 15 | Q | 73 | 912 | 0.08 | ○ | 574 | 741 | 8 |
| 16 | R | 89 | 940 | 0.09 | ○ | 542 | 721 | 8 |
| 17 | S | 20 | 475 | 0.04 | ○ | 621 | 745 | 8 |
| 18 | T | 153 | 895 | 0.17 | X | 592 | 705 | 8 |
| 19 | U | 82 | 785 | 0.10 | ○ | 605 | 704 | 11 |
| 20 | V | 46 | 814 | 0.06 | ○ | 621 | 741 | 8 |
| 21 | W | 67 | 708 | 0.09 | ○ | 635 | 705 | 8 |
| 22 | X | 71 | 888 | 0.08 | ○ | 451 | 712 | 8 |
| 23 | Y | 69 | 809 | 0.09 | ○ | 521 | 695 | 8 |
| 24 | Z | 90 | 812 | 0.11 | ○ | 585 | 695 | 7 |
| 25 | AA | 125 | 715 | 0.17 | X | 412 | 711 | 19 |
| 26 | AB | 135 | 818 | 0.17 | X | 205 | 721 | 27 |
| 27 | AC | 105 | 785 | 0.13 | X | 621 | 795 | 10 |
| 28 | AD | 123 | 521 | 0.24 | X | 589 | 765 | 9 |
| 29 | AE | 102 | 621 | 0.16 | X | 596 | 764 | 10 |

| Experiment symbol | #2 Std cold rolling reduction (%) | Overaging temperature T3 (° C.) | Overaging time t (s) | Formula (2) | Formula (2) determination | Can body breakage |
|---|---|---|---|---|---|---|
| 1 | 2 | 355 | 120 | 640 | ○ | ○ |
| 2 | 1 | 342 | 125 | 593 | ○ | ○ |
| 3 | 1 | 402 | 301 | 717 | ○ | ○ |
| 4 | 1 | 356 | 178 | 489 | ○ | ○ |
| 5 | 1 | 350 | 95 | 643 | ○ | ○ |
| 6 | 1 | 348 | 102 | 615 | ○ | ○ |
| 7 | 3 | 359 | 125 | 513 | ○ | ○ |
| 8 | 1 | 375 | 136 | 633 | ○ | ○ |
| 9 | 1 | 323 | 201 | 606 | ○ | ○ |
| 10 | 3 | 365 | 256 | 539 | ○ | ○ |
| 11 | 1 | 351 | 297 | 590 | ○ | ○ |
| 12 | 2 | 350 | 398 | 610 | ○ | ○ |
| 13 | 1 | 349 | 405 | 643 | ○ | ○ |
| 14 | 1 | 321 | 59 | 395 | ○ | ○ |
| 15 | 1 | 375 | 124 | 605 | ○ | ○ |
| 16 | 1 | 298 | 102 | 423 | ○ | ○ |
| 17 | 2 | 301 | 152 | 638 | ○ | X |
| 18 | 3 | 451 | 203 | 660 | ○ | X |
| 19 | 1 | 321 | 105 | 509 | ○ | X |
| 20 | 2 | 356 | 85 | 602 | ○ | X |
| 21 | 1 | 351 | 652 | 638 | ○ | X |
| 22 | 1 | 348 | 120 | 451 | ○ | X |
| 23 | 1 | 339 | 54 | 569 | ○ | X |
| 24 | 2 | 321 | 201 | 656 | ○ | X |
| 25 | 3 | 115 | 62 | 276 | X | X |
| 26 | 2 | 302 | 89 | 271 | X | X |
| 27 | 2 | 350 | 125 | 1910 | X | X |
| 28 | 2 | 489 | 132 | 1103 | X | X |
| 29 | 2 | 368 | 988 | 1103 | X | X |

carbides and the formula (1) is not satisfied, can body breakage during can forming occurs frequently.

Hitherto, the present invention has been described with a focus on the embodiment, but the present invention is not limited to the above-described embodiment and can be in various aspects.

The invention claimed is:

1. A steel sheet for a can comprising, by mass %:

C: 0.010% to 0.050%;
Si: 0.020% or less;
Mn: 0.10% to 0.60%;
P: 0.020% or less;
S: 0.020% or less;
Al: 0.050% or less;
N: 0.0100% or less;
Nb: 0% to 0.03%;
Ti: 0% to 0.03%;
B: 0% to 0.0020%; and
a remainder including Fe and unavoidable impurities, wherein, among carbides observed in a cross section of the steel sheet for a can, when the number of carbides having an equivalent circle diameter of 2 μm or more and 5 μm or less is indicated by a, and the number of carbides having an equivalent circle diameter, which is measured by using analysis software provided in a microscope VBX500 manufactured by KEYENCE Corporation, of 0.1 μm or more and less than 2 μm is indicated by b, a/b satisfies a range of the following formula (1), a fracture strain is 1.6 or more, and a sheet thickness is 0.10 to 0.30 mm $$a/b<0.12 \quad \ldots (1).$$

2. The steel sheet for a can according to claim 1, comprising, by mass %, at least one selected from the group of:

Nb: 0.003% to 0.03%;
Ti: 0.003% to 0.03%; and
B: 0.0005% to 0.0020%.

3. The steel sheet for a can according to claim 2, wherein a Sn plating, a Cr plating, or a plating of an alloy thereof is provided on a surface of the steel sheet for a can.

4. The steel sheet for a can according to claim 1, wherein a Sn plating, a Cr plating, or a plating of an alloy thereof is provided on a surface of the steel sheet for a can.

5. The steel sheet for a can according to claim 4, wherein an organic membrane or a resin membrane is provided on a surface of the plating.

6. A manufacturing method of a steel sheet for a can according to claim 1 that is formed by hot-rolling a steel piece containing, by mass %:

C: 0.010% to 0.050%;
Si: 0.020% or less;
Mn: 0.10% to 0.60%;
P: 0.020% or less;
S: 0.020% or less;
Al: 0.050% or less;
N: 0.0100% or less;
Nb: 0% to 0.03%;
Ti: 0% to 0.03%;
B: 0% to 0.0020%; and
a remainder including Fe and an impurity, then, coiling a hot-rolled sheet obtained by the hot rolling at a coiling temperature of 640° C. or lower, pickling and cold-rolling the hot-rolled sheet to obtain a cold-rolled sheet, then, annealing the cold-rolled sheet at 680° C. or higher, carrying out an overaging treatment on the annealed cold-rolled sheet, and then carrying out secondary cold rolling, wherein the following formula (2) is satisfied, $$300<3T_1^{0.7}-(r1/r2)^{1.5}+\{(T_2-720)^2\}/4+(T_3 \log t)/3<1000 \quad (2)$$

in the formula (2), $T_1$ is the coiling temperature (° C.) of the hot-rolled sheet, r1 is a first stand rolling reduction (%) of the secondary cold rolling, r2 is a second stand rolling reduction (%) of the secondary cold rolling, $T_2$ is an annealing temperature (° C.), $T_3$ is an overaging temperature (° C.), and t is an overaging time (seconds).

7. The manufacturing method of a steel sheet for a can according to claim 6, wherein the steel piece contains, by mass %, at least one selected from the group of:

Nb; 0.003% to 0.03%;
Ti: 0.003% to 0.03%; and
B: 0.0005% to 0.0020%.

8. The manufacturing method of a steel sheet for a can according to claim 7, wherein a Sn plating, a Cr plating, or a plating of an alloy thereof is provided on a surface of the steel sheet for a can.

9. The manufacturing method of a steel sheet for a can according to claim 6, wherein a Sn plating, a Cr plating, or a plating of an alloy thereof is provided on a surface of the steel sheet for a can.

10. The manufacturing method of a steel sheet for a can according to claim 9, wherein an organic membrane or a resin membrane is provided on a surface of the plating.

* * * * *